US009895731B2

(12) United States Patent
Kurz et al.

(10) Patent No.: US 9,895,731 B2
(45) Date of Patent: Feb. 20, 2018

(54) METHOD AND DEVICE FOR PRODUCING A MAGNESIUM SHEET

(71) Applicant: Helmholtz-Zentrum Geesthacht Zentrum für Material-und Küstenforschung GmbH, Geesthacht (DE)

(72) Inventors: Gerrit Kurz, Hamburg (DE); Dietmar Letzig, Adendorf (DE); Werner Stahl, Kreuztal (DE)

(73) Assignee: Helmholtz-Zentrum Geesthacht Zentrum für Material-und Küstenforschung GmbH, Geesthacht (DE)

( * ) Notice: Subject to any disclaimer, the term of this patent is extended or adjusted under 35 U.S.C. 154(b) by 0 days.

(21) Appl. No.: 14/896,910

(22) PCT Filed: Dec. 3, 2014

(86) PCT No.: PCT/EP2014/076402
§ 371 (c)(1),
(2) Date: Mar. 1, 2016

(87) PCT Pub. No.: WO2015/086398
PCT Pub. Date: Jun. 18, 2015

(65) Prior Publication Data

US 2016/0271662 A1 Sep. 22, 2016

(30) Foreign Application Priority Data

Dec. 12, 2013 (EP) ..... 13196798

(51) Int. Cl.
*B21B 27/03* (2006.01)
*B21B 1/22* (2006.01)

(52) U.S. Cl.
CPC ..... *B21B 1/22* (2013.01); *B21B 27/032* (2013.01); *B21B 2001/225* (2013.01)

(58) Field of Classification Search
CPC ..... B21B 27/00; B21B 27/02; B21B 27/023; B21B 27/03; B21B 27/032; B21B 27/021
See application file for complete search history.

(56) References Cited

U.S. PATENT DOCUMENTS 5,040,398 A * 8/1991 Nakagawa ..... B21B 27/035 492/3
2002/0104358 A1* 8/2002 Hart ..... B21B 39/008 72/251
2005/0279433 A1 12/2005 Hauger

FOREIGN PATENT DOCUMENTS

DE 305632 10/1922
DE 3525950 A1 12/1986
(Continued)

OTHER PUBLICATIONS

International Preliminary Report of Patentability (with English translation), International Application No. PCT/EP2014/076402, dated Nov. 11, 2015.

(Continued)

*Primary Examiner* — Debra Sullivan
(74) *Attorney, Agent, or Firm* — Marshall, Gerstein & Borun LLP

(57) ABSTRACT

The present invention relates to a process and to an apparatus for producing a magnesium sheet from a magnesium strip in a rolling device, said process having lower material heat losses compared to known processes and requiring a lower expenditure on apparatus. In the process, the magnesium strip, after preheating, is guided through at least one roll nip formed by at least one pair of counter-rotating working rollers, which comprise a main roller body. The process is characterized in that at least one of the two (Continued)

counter-rotating working rollers comprises at least one heat-insulating sheath surrounding the main roller body.

7 Claims, 6 Drawing Sheets

(56) References Cited

FOREIGN PATENT DOCUMENTS

| | | | |
|---|---|---|---|
| DE | 102004023885 | A1 | 12/2005 |
| DE | 102006036224 | B3 | 8/2007 |
| EP | 1129796 | A2 | 9/2001 |
| EP | 2478974 | A1 | 7/2012 |
| GB | 2178509 | A | 2/1987 |
| JP | H02261922 | A | 10/1990 |

OTHER PUBLICATIONS

International Search Report for International Application No. PCT/EP2014/076402, dated Feb. 17, 2015.

* cited by examiner

METHOD AND DEVICE FOR PRODUCING A MAGNESIUM SHEET

CROSS-REFERENCE TO RELATED APPLICATIONS

This application is a National Stage of PCT/EP2014/076402 filed Dec. 3, 2014, which claims priority to European Patent Application No. 13196798.6 filed Dec. 12, 2013, the respective discloses of which are each incorporated herein by reference in their entireties.

BACKGROUND

Field of the Disclosure

The present patent application relates to a process and to an apparatus for producing a magnesium sheet from a magnesium strip in a rolling device.

Brief Description of Related Technology

The production of sheet magnesium is becoming increasingly important on account of the growing demand. In particular, it has been found that sheet magnesium is suitable for the production of vehicle bodies, the sheet magnesium having a relatively low weight combined with strength properties comparable with those of sheet aluminium.

However, the production of sheet magnesium is relatively complex compared to the production of sheet steel or sheet aluminium, since magnesium, owing to its hexagonal lattice structure, has poor deformation properties at the processing temperatures usually present during cold-rolling. To successfully produce sheet magnesium, it is therefore necessary to observe a defined temperature range lying approximately between 230° C. and 450° C.

Rolling devices for producing a magnesium strip are known in the prior art. By way of example, EP 2 478 974 A1 discloses a finish-rolling device for producing a thin magnesium strip, said finish-rolling device comprising a rolling stand for receiving two working rollers, defining a working gap, having a heating device, and also a preheating furnace for heating the magnesium strip. Furthermore, EP 2 478 974 A1 discloses a process for producing a thin magnesium strip in such a finish-rolling device.

DE 10 2006 036 224 A1 discloses a finish-rolling device for producing a magnesium strip, the operation of which involves the use of various measures for maintaining an elevated temperature level of the magnesium strip after it has entered into the finish-rolling device. Thus, for instance, the coiling devices of the finish-rolling device, which is operated in reversing mode, are provided with winding reels, these forming an outer housing of coiling mandrels, such that magnesium strip arranged on the coiling mandrel is covered by the winding reel, in order to minimize a temperature loss in the coiling device. Furthermore, a continuous furnace is arranged on the outlet side of the rolling stand and heats the magnesium sheet during operation. Owing to the heat losses which arise during operation of the roller, heating above the rolling temperature is necessary, but this has an adverse effect on the rolling stock.

DE 10 2004 023 885 A1 discloses a process for flexibly rolling magnesium strip or aluminium strip or magnesium panels or aluminium panels, in which process the strip material or the panel material is rolled out over the entire length from a starting thickness to a final thickness which varies over the length in the longitudinal direction of the rolling operation. If magnesium is used as the strip material or panel material, it is heated to a temperature of between 180° C. and 280° C. for hot-rolling.

In the known finish-rolling devices, the additional heating devices result in an increased outlay on installation and operation of the finish-rolling device, and this also concerns in particular the energy required for operating the finish-rolling device.

SUMMARY

The present invention is therefore based on the object of providing a process and an apparatus for forming a magnesium strip which reduce the above disadvantages and allow for the temperature of the magnesium strip to be controlled more effectively in the finish-rolling device, with no complex conversion measures on the plant being necessary.

These objects are achieved by a process having the features according to the claims and a rolling apparatus having the features according to the claims.

BRIEF DESCRIPTION OF THE DRAWINGS

Preferred embodiments of the invention will be explained in more detail herein below with reference to the figures which follow, in which.

DETAILED DESCRIPTION

Figure 1:
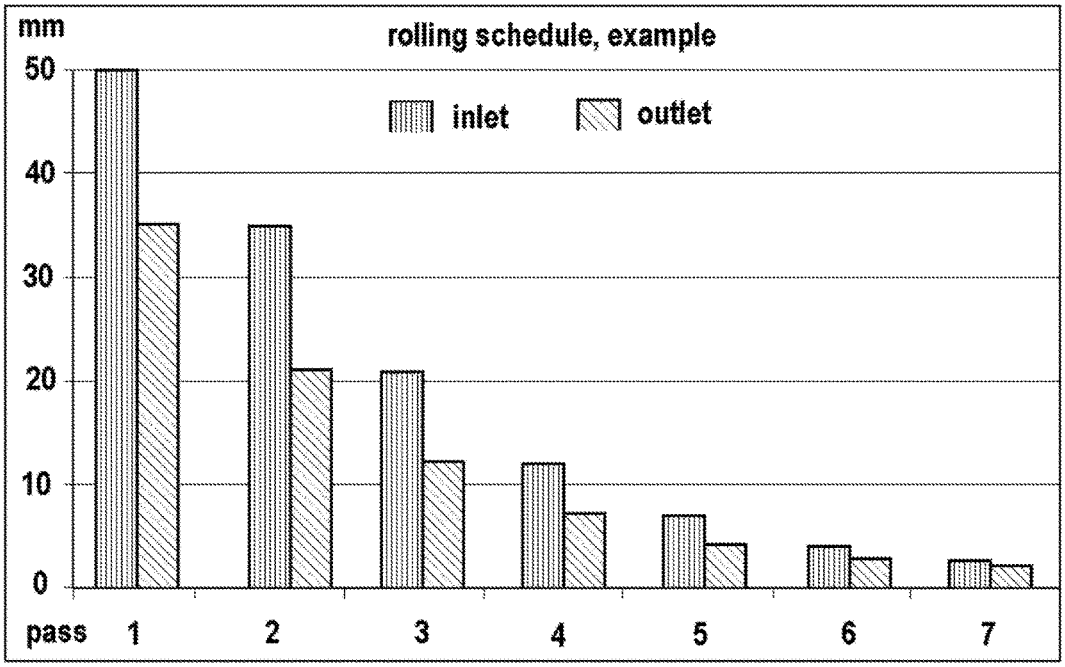
FIG. 1 shows the inlet and outlet thickness [mm] in a pass sequence according to the invention.
Figure 2:
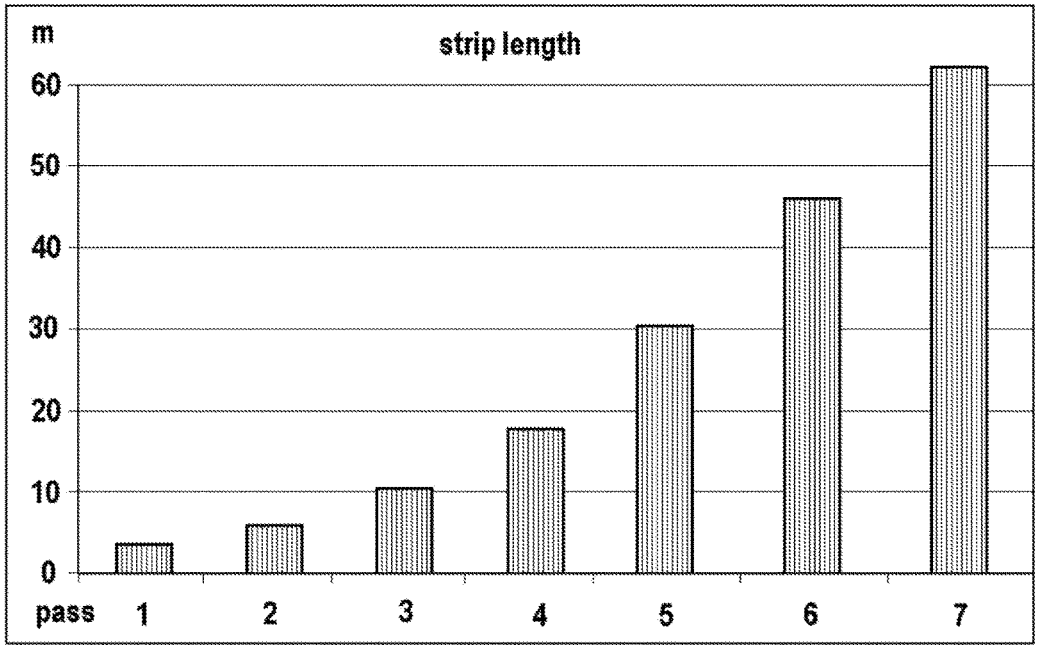
FIG. 2 shows the increase in strip length [m] in a pass sequence according to the invention.
Figure 3:
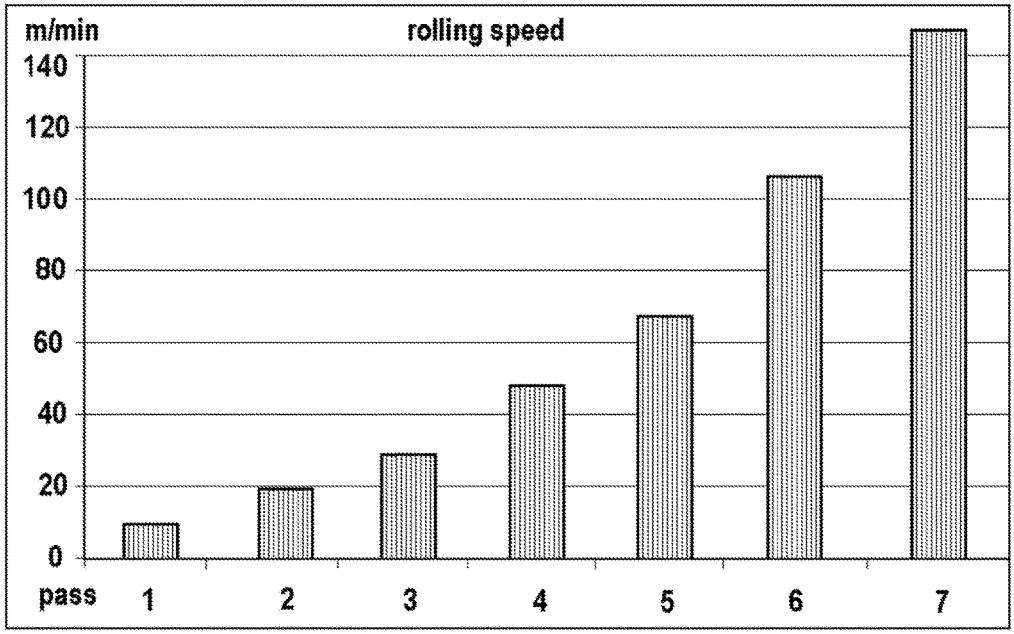
FIG. 3 shows the rolling speeds [m/min] in a pass sequence according to the invention.
Figure 4:
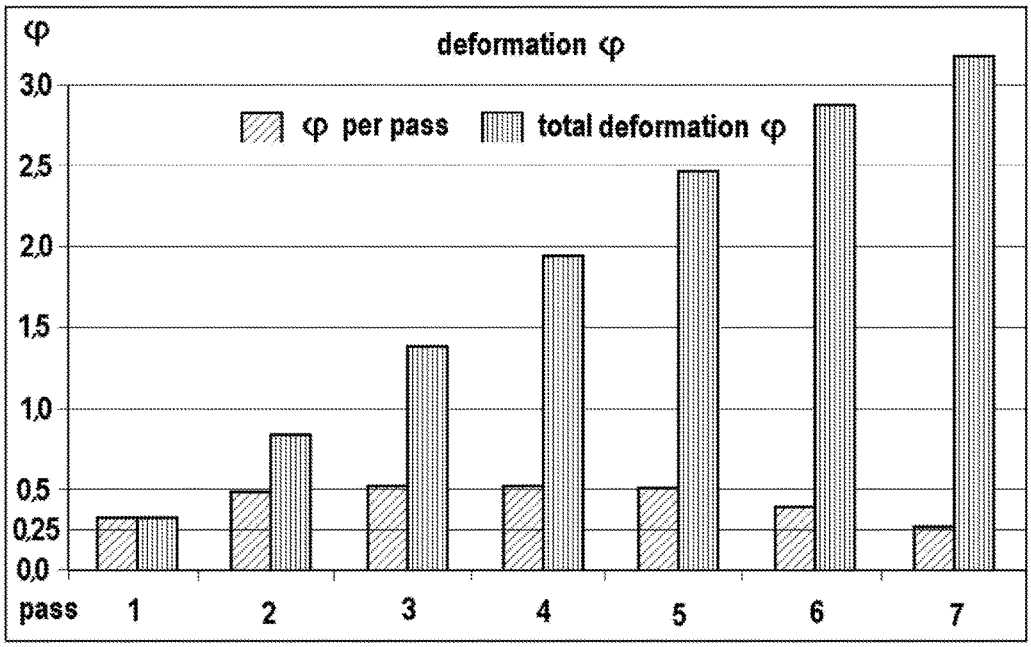
FIG. 4 shows the logarithmic individual and total forming [phi] in a pass sequence according to the invention.
Figure 5:
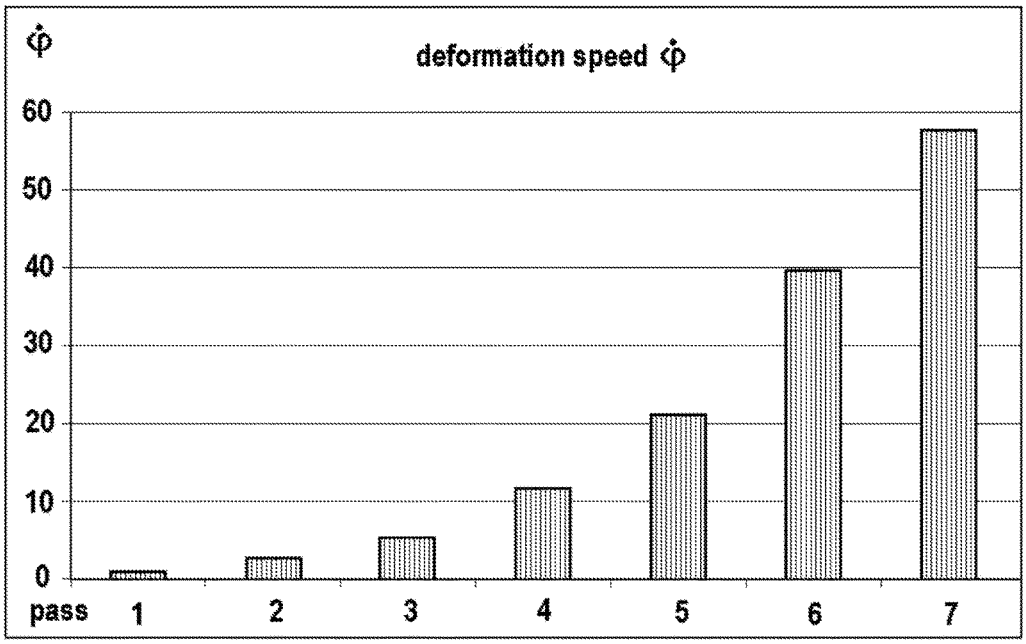
FIG. 5 shows the rate of forming/pass [Phi/s] in a pass sequence according to the invention.
Figure 6:
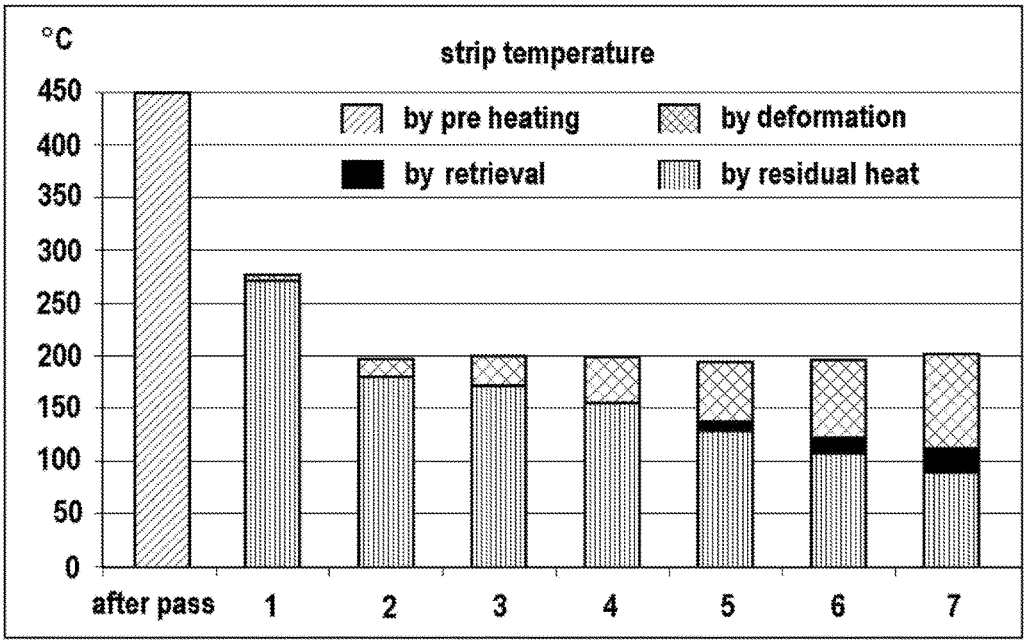
FIG. 6 shows the strip temperature [° C.] including the pro-portion of stored heat (black) and proportion of heat of forming (dark grey) in a pass sequence according to the invention.

In the rolling process according to the invention, a magnesium strip, after preheating, is guided through at least one roll nip formed by at least one pair of counter-rotating working rollers, which comprise a main roller body, wherein at least one of the two counter-rotating working rollers comprises at least one heat-insulating sheath surrounding the main roller body.

The heat-insulating sheath can have one or more layers. The heat-insulating property of the sheath can be generated by the selection of the sheath material and/or by structured surfaces which reduce the areas of contact between the sheath and the main roller body.

It is preferable that the heat-insulating sheath consists of a ceramic material. By way of example, the ceramic material of the sheath can consist of silicon nitride ($Si_3N_4$), boron nitride (BN), boron carbide ($B_4C$), calcium hexaboride ($CaB_6$), silicon carbide (SiC), titanium boride ($TiB_2$), zinc boride ($ZnB_2$) or mixed ceramics thereof. In addition to good heat insulation, this material is distinguished by a high mechanical strength, a high high-temperature resistance and a low tendency towards adhesion with respect to metallic materials. Other ceramic materials with similar properties are likewise suitable, however. Furthermore, ceramic materials are advantageous for the sheath because their use may make it possible to dispense with a lubricant.

According to a further embodiment of the invention, at least one working roller, preferably both working rollers, additionally has or have a heat-storing sheath. It is preferable that the heat-storing sheath surrounds the heat-insulating sheath.

The process according to the invention is preferably carried out in such a way that a lower rolling speed is selected in the first passes of a pass sequence than during the further course of rolling in a pass sequence, and the rolling speed is increased during the further course of rolling in a pass sequence. The comparatively slower speed in the first passes of a pass sequence allows the heat stored in the magnesium strip to flow off into the cooler sheath of the roller. The heat-insulating sheath and the possibly additionally present heat-storing sheath prevent the flow of heat into the main body of the roller, and therefore the sheath of the roller heats up to the desired working temperature in a short time. Since a flow of heat from the sheath into the main body of the roller is prevented, the heat is moreover effectively stored in the sheath. In this way, the sheath of the roller can be heated up to the required working temperature by the flow of heat from the preheated magnesium strip into the sheath of the roller alone. Additional heating of the roller by external heating elements or heating elements fitted in the roller is no longer required for this purpose. During the further course of rolling in the pass sequence, the thus heated sheath releases heat again to the metal strip upon increasing cooling of the metal strip. The heat of forming which increases as the rolling speed increases ensures that the metal strip is additionally heated. This has the effect that the rolling stock already scarcely has to still be additionally heated during the second pass sequence, even if additional heating of the roller by external heating elements or heating elements fitted in the roller is dispensed with. According to the invention, it is therefore the case that none of the working rollers is heated by external heating elements or heating elements fitted in the rollers. Heating devices for heating the roller are therefore replaced completely by the heat-insulating sheath and the possibly additionally present heat-storing sheath.

If a heat-storing sheath surrounds the heat-insulating sheath, this effect is enhanced additionally. Relatively minor preheating of the magnesium strip is required.

The process can be carried out in a conventional reversing rolling mill. A heat-insulating sheath is likewise advantageous where temperature-controlled strip touches the production components. Alternatively, it can also be employed in a multi-stand tandem mill train, for example such as that shown in FIG. 1 of EP 1 129 796 A2, to which reference is made here. The use of the process according to the invention in a tandem mill train has the advantage of further improved exploitation of energy and, through a direct feed of rolled strip, prevents further heat losses to deflection rollers and drive devices.

The process according to the invention and the rolling apparatus according to the invention can advantageously also be used in a flexible rolling process, in which the strip material is rolled out over the entire length from a starting thickness to a final thickness which varies over the length in the longitudinal direction of the rolling operation.

As is apparent from the figures, the return flow of the stored heat and the increase in the heat of forming increase continuously when using a heat-insulating and heat-storing sheath for the roller, and this has the effect that the rolling stock made of magnesium already does not require additional heating of the rollers during the second roll pass.

The invention claimed is:

1. A method for producing a magnesium sheet from a magnesium strip in a rolling device, comprising:

preheating a magnesium strip; and guiding the preheated magnesium strip through at least one roll nip formed by at least one pair of counter-rotating working rollers; and rolling the preheated magnesium strip with the at least one pair of counter-rotating working rollers to form the magnesium sheet, wherein:

each of the counter-rotating working rollers of the at least one pair of counter-rotating working rollers comprises a main roller body, both of the counter-rotating working rollers of the at least one pair of counter-rotating working rollers comprises at least one heat-insulating sheath surrounding the main roller body and a heat-storing sheath surrounding the heat-insulating sheath, and none of the counter-rotating working rollers is heated by external heating elements or heating elements fitted in the counter-rotating working rollers.

2. The method of claim 1, wherein the heat-insulating sheath consists of a ceramic material.

3. The method of claim 1, wherein each of the counter-rotating working rollers of the at least one pair of counter-rotating working rollers is arranged in a reversing rolling mill between two coiling devices, which can reversibly coil and uncoil a rolling stock.

4. The method of claim 1, wherein the counter-rotating working rollers of the at least one pair of counter-rotating working rollers are arranged in a rolling mill train having a series of pairs of working rollers arranged in succession.

5. The method of claim 1, wherein the preheated magnesium strip is guided through the at least one roller nip in a series of passes forming a pass sequence having a predetermined rolling speed, and a lower rolling speed is selected in first passes of the pass sequence than during further passes in the pass sequence, and the rolling speed is increased during the further passes in the pass sequence.

6. A method for producing a magnesium sheet from a magnesium strip in a rolling device, comprising:

preheating a magnesium strip; and guiding the preheated magnesium strip through at least one roll nip formed by at least one pair of counter-rotating working rollers; and rolling the preheated magnesium strip with the at least one pair of counter-rotating working rollers to form the magnesium sheet, wherein:

each of the counter-rotating working rollers of the at least one pair of counter-rotating working rollers comprises a main roller body, at least one of the counter-rotating working rollers of the at least one pair of counter-rotating working rollers comprises at least one heat-insulating sheath surrounding the main roller body, the counter-rotating working rollers of the at least one pair of counter-rotating working rollers are arranged in a rolling mill train having a series of pairs of working rollers arranged in succession, and none of the counter-rotating working rollers is heated by external heating elements or heating elements fitted in the counter-rotating working rollers.

7. The method of claim 6, wherein the preheated magnesium strip is guided through the at least one roller nip in a series of passes forming a pass sequence having a predetermined rolling speed, and a lower rolling speed is selected in first passes of the pass sequence than during further passes in the pass sequence, and the rolling speed is increased during the further passes in the pass sequence.

* * * * *